US005797789A

United States Patent [19]

Tanaka et al.

[11] Patent Number: 5,797,789

[45] Date of Patent: Aug. 25, 1998

[54] POLISHING SYSTEM

[75] Inventors: Koichi Tanaka; Toshihiro Tsuchiya; Koji Morita; Tsutomu Takaku, all of Nishi-shirakawa-gun, Japan

[73] Assignee: Shin-Etsu Handotai Co., Ltd., Tokyo, Japan

[21] Appl. No.: 810,915

[22] Filed: Mar. 5, 1997

[30] Foreign Application Priority Data

Mar. 28, 1996 [JP] Japan ..... 8-074518

[51] Int. Cl.[6] ..... B24B 1/00

[52] U.S. Cl. ..... 451/289; 451/5; 451/7; 451/41; 451/285; 451/286; 451/287; 451/288; 451/388

[58] Field of Search ..... 451/41, 285–289, 451/388, 53, 5, 7

[56] References Cited

U.S. PATENT DOCUMENTS

| | | | |
|---|---|---|---|
| 4,597,228 | 7/1986 | Koyama et al. | 451/388 |
| 4,671,145 | 6/1987 | Fehrenback et al. | 451/388 |
| 5,423,558 | 6/1995 | Koeth et al. | 451/388 |
| 5,441,444 | 8/1995 | Nakajima | 451/388 |
| 5,605,489 | 2/1997 | Gale et al. | 451/388 |
| 5,670,011 | 9/1997 | Togawa et al. | 451/41 |

*Primary Examiner*—Robert A. Rose
*Assistant Examiner*—George Nguyen
*Attorney, Agent, or Firm*—Oliff & Berridge, PLC

[57] ABSTRACT

A polishing system for polishing a wafer or the like, comprises: a vacuum system comprising a vacuum pump and a vacuum passage connected thereto; a fluid supply system comprising a fluid source and a fluid passage connected thereto; a polishing head comprising a holding member for holding the wafer or the like on the lower surface thereof which has at least one through hole in communication with the vacuum passage and the fluid passage; and a polishing member. Polishing of the wafer or the like is performed by pressing the wafer or the like held on the lower surface of the holding member, against the polishing member while providing relative motion between the holding member and the polishing member and supplying an abrasive slurry to the polishing member. Separation of the wafer or the like from the polishing head is performed by injecting a fluid from the fluid supply system to the object through the through hole of the holding member. A gelation suppression member for suppressing gelation of the abrasive slurry sucked into the through hole or the vacuum passage is provided in the course of the vacuum passage.

18 Claims, 7 Drawing Sheets

POLISHING SYSTEM

BACKGROUND OF THE INVENTION

1. Field of the Invention

The present invention relates to a polishing system for polishing an object having a flat surface such as a semiconductor wafer or a thin plate.

2. Description of Related Art

An example of a conventional polishing system used for polishing a semiconductor wafer is shown in FIG. 7. The polishing system 1 comprises: a polishing head 10 comprising a top ring 15 which is rotatable on its axis by a head driving motor 2, and a holding plate 13 for holding a wafer 12 on the lower surface thereof, which is mechanically connected to the top ring 15; a turn table 23 which is rotatable on its axis by a turn table driving motor 3 and has a polishing pad 25 on the upper surface thereof; a vacuum system comprising a vacuum pump 16, and a vacuum passage 14 for communicating the vacuum pump 16 with the polishing head 10 through a solenoid operated valve 14*a;* and a separating gas supply system comprising a gas supply for supplying a gas such as air into the polishing head 10, and a gas passage 19 for communicating the gas supply with the polishing head 10 through a solenoid operated valve 19*a* and a pressure reducing valve 19*b*. A plurality of through holes 13*a* are formed in the lower surface of the holding plate 13, and these holes are communicated with the outer vacuum pump 16 through the vacuum passage 14, as shown in FIG. 8. A wafer 12 is held on the lower surface of the holding plate 13 by vacuum suction through the through holes 13*a* and the vacuum passage 14 and is then pressed against the polishing pad 25 while the wafer 12 and the polishing pad 25 on the turn table 23 are relatively rotated by the head driving motor 2 and the turn table driving motor 3, respectively. Thus, polishing for the wafer 12 is carried out by the relative rotation between the wafer 12 and the polishing pad 25 while supplying an abrasive slurry 4 to the polishing pad 25. Generally, as the abrasive slurry 4, abrasive grains of colloidal silica dispersed in an alkali aqueous solution are used, and the polishing is carried out by the so-called mechano-chemical function which compounds a mechanical function and a chemical function.

The vacuum passage 14 and the gas passage 19 meet each other in the polishing head 10. In this polishing system 1, when wafer polishing is accomplished, the solenoid operated valve 14*a* in the vacuum passage 14 is closed and then the solenoid operated valve 19*a* in the gas passage 19 to jet air through the through holes 13*a* of the holding plate 13, so that the wafer 12 is separated from the holding plate 13. Thereafter, the lower surface of the holding plate 13 is cleaned by using a brush and pure water.

A reason for carrying out the cleaning is the following.

Although it is preferable that there is no gap between the wafer 12 and the holding plate 13 during holding the wafer 12 on the lower surface of the holding plate 13, in practice, small gaps are generally in existence between them because of roughness of the contact surfaces thereof.

Therefore, during polishing of the wafer 12, a part of the abrasive slurry 4 is sucked by vacuum into the through holes 13*a* and the inside of the top ring 15 through the small gaps, as shown in FIG. 9A. In this case, because the inside of the vacuum passage 14 is kept in an evacuated state, water in the sucked abrasive slurry evaporates and the vapor is removed out of the vacuum passage 14 by the vacuum pump 16. Consequently, the concentration of the abrasive slurry 4 increases, so that the abrasive slurry 4 begins to gel and eventually changes into a solid state.

When the wafer 12 is separated from the holding plate 13, the particles changed into a solid state are scattered to the outside together with the air for separating. A part of the scattered particles 5 are adhered to the lower surface of the holding plate 13, as shown in FIG. 9B. In order to remove such particles 5 adhered to the lower surface of the holding plate 13, cleaning by using a brush and pure water is required.

However, such a cleaning does not completely remove the particles adhered to the lower surface of the holding plate 13 frequently. The particle 5 remaining on the lower surface of the holding plate 13 causes the following problems.

When the holding plate 13 sucks to hold the next wafer 12 on the lower surface thereof in order to polish it, the particle 5 adhered to the lower surface of the holding plate 13 is be sandwiched between holding plate 13 and the wafer 12, as shown in FIG. 9C. During polishing of the wafer 12, the portion of the wafer 12 which is in contact with the particle 5 is strongly pressed against the polishing pad 25 in comparison with the other portion, so that polishing for just the portion of the wafer 12 in contact with the particle is accelerated, as shown in FIG. 9D. Consequently, the problem of formation of a dimple at the portion of the wafer 12 in contact with the particle occurs when the wafer 12 is separated from the holding plate 13, as shown in FIG. 9E.

The above-described abrasive slurry 4 includes an alkali agent for adjusting the pH of the abrasive slurry or for improving the stability of colloidal silica. When water in the abrasive slurry evaporates and is removed out of the vacuum passage 14, the concentration of the agent in contact with the particle increases, so that the problem of the rear surface of the wafer 12 being etched by the agent with higher concentration is encountered.

In a process for fabricating a semiconductor integrated circuit, with the requirement of larger scale integration of recent semiconductor devices, finer design rule for fabricating a device and shallower depth of focus of a stepper which is used in a photolithography process are required. Consequently, there have been strong demands towards flatness of a wafer in the wafer polishing step. Under these circumstances, the above-described problems must be solved as perfectly as possible.

SUMMARY OF THE INVENTION

The present invention was developed in view of these problems.

An object of the present invention is to obtain a polishing system which results in improvement in flatness of an object having a flat surface such as a semiconductor wafer or a thin plate.

Another object of the present invention is to obtain a polishing system for an object having a flat surface such as a semiconductor wafer or a thin plate, which can suppress contamination during polishing.

That is, in accordance with one aspect of the present invention, the polishing system for polishing an object having a flat surface, comprises: a vacuum system comprising a vacuum pump and a vacuum passage connected thereto; a fluid supply system comprising a fluid source and a fluid passage connected thereto; a carrier comprising a holding member for holding the object on the lower surface thereof which has at least a through hole communicated with the vacuum passage and the fluid passage; and a polishing member; wherein polishing of the object is carried out by pressing the object held on the lower surface of the holding member, against the polishing member while providing relative motion between the holding member and the polishing member and supplying an abrasive slurry to the polishing member; separation of the object from the carrier is carried out by injecting a fluid from the fluid supply system to the object through the through hole of the holding member; and a gelation suppression member for suppressing gelation of the abrasive slurry sucked into the through hole or the vacuum passage is provided in the course of the vacuum passage.

The present invention can be applied for polishing any objects having a flat surface, e.g., various types of thin plates, substrates, rectangular parallelepiped products or the like. In particular, it is very effective to apply for polishing a thin plate such as a semiconductor wafer because of strong demands towards flatness of a wafer and towards suppression of contamination in the wafer polishing step.

According to the polishing system having the above construction, gelation of the abrasive slurry can be suppressed in the through hole of the holding member and in the vacuum passage, and the above-described problems caused by solidification of the abrasive slurry can be eliminated.

Preferably, the gelation suppression member provided in the course of the vacuum passage comprises a vapor supply tank containing pure water therein. The vapor supply tank containing pure water may be provided inside the carrier, e.g., on the upper surface of the holding member. The holding member may be also have a groove for storing water which is formed in an inner surface thereof and is communicated with the vacuum passage. According to such a construction having means for storing water arranged near the positions at which sucked abrasive slurry are liable to exist in the vacuum passage, it is possible to obtain a larger effect of suppressing gelation of the abrasive slurry.

Preferably, a tank containing pure water therein, for humidifying the fluid in the fluid passage, is provided in the course of the fluid passage. Accordingly, it is possible to reduce evaporation of water in the sucked abrasive slurry in the separating fluid because the fluid in the fluid passage is humidified by the vapor from the tank. A portion of the vacuum passage may double as a portion of the fluid passage.

The gelation suppression member preferably keeps the vapor pressure of water in the vacuum passage at a value not lower than that of the abrasive slurry. The gelation suppression member may comprise a vapor supply tank containing pure water therein, a heater for heating the pure water in the vapor supply tank, and a temperature control device for detecting the temperature of the pure water and controlling the heater on the basis of the detected temperature. Accordingly, evaporation of water from the abrasive slurry which exists in the vacuum passage and the like, and gelation of the abrasive slurry can be suppressed.

Preferably, the vacuum pump is a water ring type, and the gelation suppression member keeps the temperature of sealing water of the vacuum pump at a value higher than that of the abrasive slurry. According to the polishing system having such a construction, because water evaporates from the sealing water to increase the steam pressure in the vacuum passage, evaporation of water in the abrasive slurry is suppressed and thereby gelation of the abrasive slurry can be further suppressed.

The gelation suppression member may have a construction which can pour water into the through hole and the vacuum passage to lower the concentration of the abrasive slurry sucked into the through hole or the vacuum passage. Accordingly, the abrasive slurry in the through hole or the vacuum passage is diluted by the poured water. The water may be poured prior to holding the object on the holding plate by vacuum suction and may be also poured through another passage other than the vacuum passage, after holding the object on the holding plate by vacuum suction.

The gelation suppression member may have a construction which can clean the through hole or the vacuum passage. The best time for such a cleaning is after polishing of an object and before polishing of the next object. It is preferable to carry out such cleaning at high frequencies, that is, to carry out for every piece rather than every several pieces. According to such a cleaning of the through hole or the vacuum passage, the above-described problems caused by solidification of the abrasive slurry can be dissolved.

In accordance with another aspect of the present invention, the polishing system comprises: a carrier having a holding member for holding an object on the lower surface thereof which has at least a through hole communicated with a vacuum pump through a vacuum passage and with a fluid supply system through a fluid passage; and a polishing member; wherein polishing for the thin plate is carried out by pressing the thin plate held on the lower surface of the holding member, against the polishing member while providing relative motion between the holding member and the polishing member and supplying an abrasive slurry to the polishing member; separation of the object from the carrier is carried out by injecting a fluid from the fluid supply system to the object through the through hole of the holding member; and the vacuum passage and the fluid passage are provided independently. The carrier may comprise: a rotatable polishing head comprising a first inner passage which functions as a part of the fluid passage, and a second inner passage which functions as a part of the vacuum passage; and the holding member attached to the lower surface of the polishing head, which has a first through hole at approximately the central position thereof and a second plurality of through holes around the central position; wherein first and second inner spaces are independently formed between the polishing head and the holding member, and the first inner passage, the first inner space, and the first through hole are communicated with one another, and the second inner passage, the second inner space, and the second through holes are communicated with one another, independently.

According to the polishing system, even if the abrasive slurry is gelated to deposit on an inner surface of the through hole or of the vacuum passage, it is possible to reduce the possibility of scattering of the particles to the outside of the vacuum passage together with the fluid for separating when jetting the fluid to separate the object from the holding member.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

Embodiments of a polishing system for a thin plate according to the present invention will be explained with reference to the drawings, as follows. In Figures showing the embodiments of the present invention, the same reference numbers will be attached to approximately the same systems, structural members, elements or the like.

Figure 1:
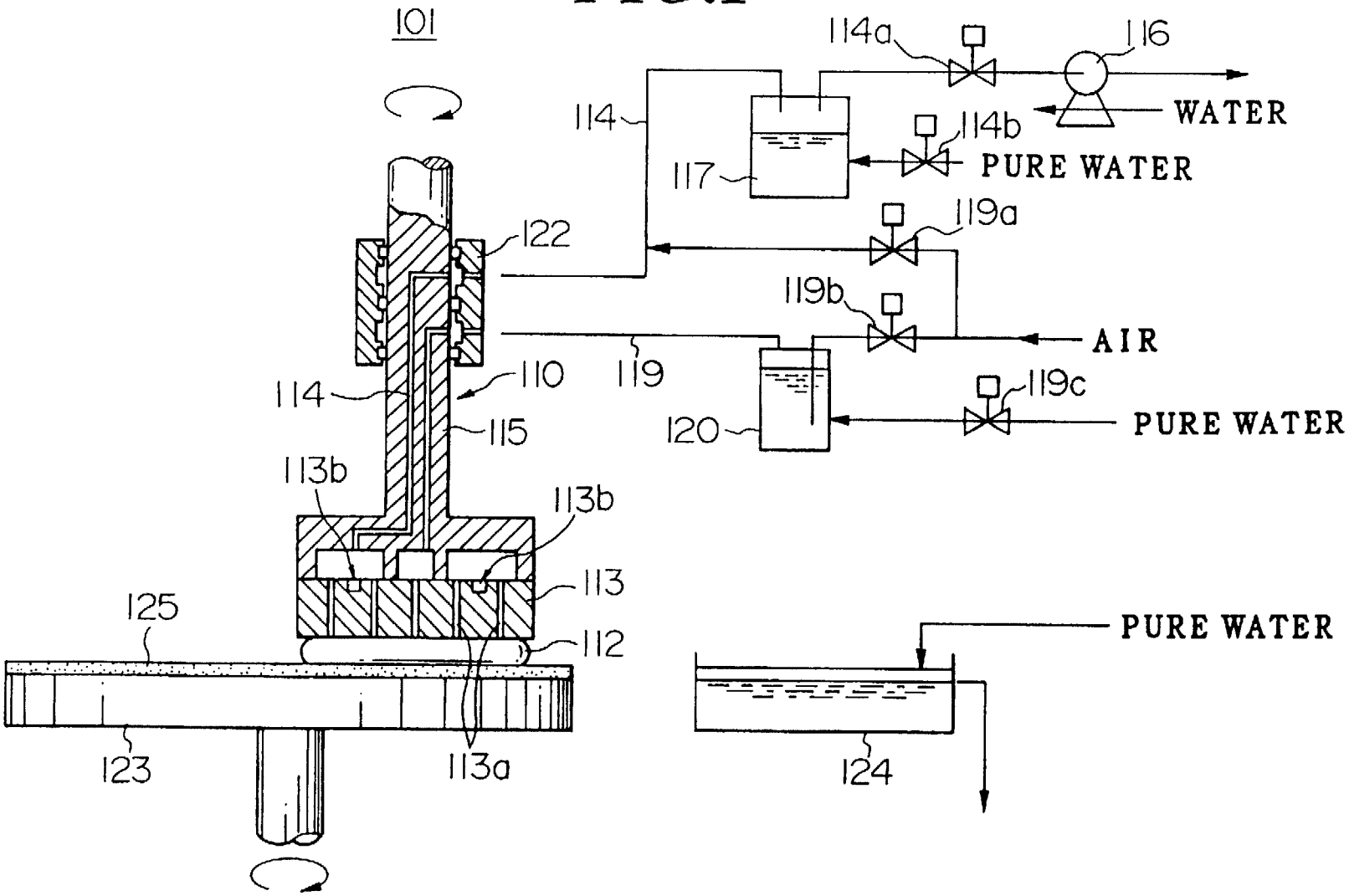
FIG. 1 is a partial sectional view showing a polishing system for a wafer according to a first embodiment of the invention.

A polishing system for polishing a semiconductor wafer according to a first embodiment of the invention is shown in FIG. 1. The polishing system 101 comprises; a polishing head 110 comprising a rotatable polishing head main body (shaft and top ring) 115, and a holding member 113 for holding a wafer 112 on the lower surface thereof; a polishing member comprising a rotatable turn table 123 and a polishing pad 125 adhered thereon; a vacuum system for supplying a suction force to the polishing head 110; and a fluid supply system for supplying a fluid such as jetted air to the polishing head 110, for separating a held wafer 112 from the polishing head 110.

The holding member 113 of the polishing head 110 has a disc shape and has a plurality of through holes 113*a* penetrating through the holding member 113 in a vertical direction. On the upper surface of the holding member 113, a plurality of grooves 113*b* for storing pure water therein are formed at positions not to interfere with the through holes 113*a*. The holding member 113 is mechanically connected to the polishing head main body 115.

In the polishing head main body 115, a vacuum passage 114 which communicates with the through holes 113*a* in the periphery side of the holding member 113, is formed. The vacuum passage 114 extends to the outside of the polishing head main body 115 to connect to the vacuum pump 116. The vacuum pump 116 is, although it is not limited to this, of a water ring type. Between the polishing head main body 115 and the vacuum pump 116 in the vacuum passage 114, a vapor supply tank 117 containing pure water therein is provided. The pure water contained in the vapor supply tank 117 acts to increase the vapor pressure of water in the vacuum passage 114 to some extent by its evaporation when the inside of the vacuum passage 114 is depressurized. Particularly, it acts to increase the vapor pressure of water in the vacuum passage 114 up to a pressure higher than the vapor pressure of water from the abrasive slurry. In order to easily control the vapor pressure, the temperature of the pure water in the vapor supply tank 117 is maintained at approximately the same temperature as that of the abrasive slurry by using a temperature control device (not shown). A pure water source connected to the vapor supply tank 117 is provided near the tank 117, in order to supply pure water properly when the pure water in the vapor supply tank 117 is reduced. In FIG. 1, the reference numerals 114*a* and 114*b* denote solenoid operated valves.

In the polishing head main body 115, a fluid passage 119 which is communicated with the through hole 13*a* near the center of the holding member 113, is formed. The fluid passage 119 extends to the outside of the polishing head main body 115 to connect to a fluid supply source (not shown) for supplying jetted air. Between the polishing head main body 115 and the fluid supply source in the fluid passage 119, a fluid humidifying tank 120 containing pure water therein is arranged. The air for separating a wafer 112 from the polishing head 110 is passed through the pure water contained in the fluid humidifying tank 120 to be suitably humidified during passing therethrough. The fluid passage 119 is branched at a position between the fluid humidifying tank 120 and the fluid supply source. One of the branched passages is connected to the through hole 113*a* near the center of the holding member 113 through the fluid humidifying tank 120, and the other of the branched passages is connected to the course of the vacuum passage 114. That is, a part of the vacuum passage 114 doubles as a part of the fluid passage 119. A pure water source connected to the fluid humidifying tank 120 is provided near the tank 120, in order to supply pure water properly when the pure water in the fluid humidifying tank 120 is reduced. In FIG. 1, the reference numerals 119*a*, 119*b* and 119*c* denote valves.

In the vacuum passage 114 and the fluid passage 119, a rotary joint 122 is used in order to connect the respective passages in the polishing head main body 115 with the respective passages out thereof.

The polishing system 1 has a construction so that the polishing head 110 can be moved among the positions of the turn table 123, a centering device (not shown), a cleaning tank 124 for cleaning the inside of the polishing head main body 115, and a brush cleaning part (not shown). Pure water is contained in the cleaning tank 124. In the brush cleaning part, the polishing head main body 115 is cleaned by using a brush while showering pure water. In FIG. 1, the reference numeral 125 denotes a polishing pad made of polyurethane foam, unwoven cloth or the like, adhered on the upper surface of the turn table 123.

Other elements, means or the like are approximately the same as those corresponding to them in the above-described conventional polishing system.

Next, the function of the polishing system 101 according to this embodiment will be explained, as follows.

The wafer 112 to be polished is placed on the centering device horizontally, and is thereafter centered. Pure water is showered on the upper surface of the wafer 112 to form a water film thereon. Next, the polishing head 110 with the holding member 113 is moved to the above position of the wafer 112, and thereafter the solenoid operated valve 114*a* is opened to discharge air from the vacuum passage 114 by the vacuum pump 116, so that the wafer 112 is held on the lower surface of the holding member 113 by vacuum suction. During the vacuum suction, the pure water adhering on the upper surface of the wafer 112 as a water film is brought into the vacuum passage 114. The pure water which is brought into the vacuum passage 114 dilutes the abrasive slurry sucked in the vacuum passage to suppress gelation of the abrasive slurry.

Next, the rotating polishing head 110 with the wafer 112 is lowered onto the polishing pad 125 adhering to the turn table 123 and presses the wafer 112 against the polishing pad 125 with a predetermined load, while providing relative motion between the polishing head 110 and the polishing pad 125 and supplying an abrasive slurry comprising abrasive grains of colloidal silica dispersed in an alkali aqueous solution, or the like, to the polishing pad 125, so that the lower surface of the wafer 112 is polished. When air in the vacuum passage 114 is sucked by the vacuum pump 116 so that the partial pressure of the vapor of water in the vacuum passage 114 is lowered during the polishing, the pure water in the vapor supply tank 117 and the pure water in the grooves 113*b* of the holding member 113 are evaporated. Consequently, the partial pressure of the vapor of water in the vacuum passage 114 is kept approximately constant, that is, higher than the vapor pressure of water from the abrasive slurry. Accordingly, evaporation of water in the abrasive slurry which exists between the wafer 112 and the holding member 113, in the through holes 113*a* of the holding member 113, and in the vacuum passage 114, is suppressed. As a result, gelation of the abrasive slurry and also generation of solid particles can be suppressed. After the polishing is continued for a predetermined time, the polishing head 110 is lifted to complete the polishing step.

After the polishing is completed, the solenoid operated valve 114*a* is closed and the solenoid operated valves 119*a* and 119*b* are opened to blow air in the polishing head 110, so that the wafer 112 is separated from the lower surface of the holding member 113. Because the separating air includes humidity by passing through the fluid humidifying tank 120 in the course of the fluid passage 119, it slightly makes the lower surface of the holding member 113 or the like dry. The separated wafer 112 is received by a device which is not shown in the Figure.

On the other hand, the polishing head 110 from which the wafer 112 was detached is transferred to the position above the cleaning tank 124 for cleaning the inside of the polishing head main body 115, and thereafter it is lowered to dip the lower portion of the holding member 113 into the pure water in the cleaning tank 124. In this position, the solenoid operated valve 114*a* is opened to suck the pure water in the cleaning tank 124 into the vacuum passage 114. Thereafter, the solenoid operated valve 114*a* is closed and the solenoid operated valves 119*a* and 119*b* are opened to discharge the water in the vacuum passage 114 therefrom. Such suction and discharge are repeated several times, so that the abrasive slurry and the like in the vacuum passage 114 can be removed to clean the passage 114. During these operations, pure water is supplied into the grooves 113*b* for supplying steam of the holding member 113. Thereafter, the polishing head 110 is transferred to the brush cleaning part and the lower and side surfaces of the holding member 113 are cleaned by using a brush while showering pure water.

Figure 2:
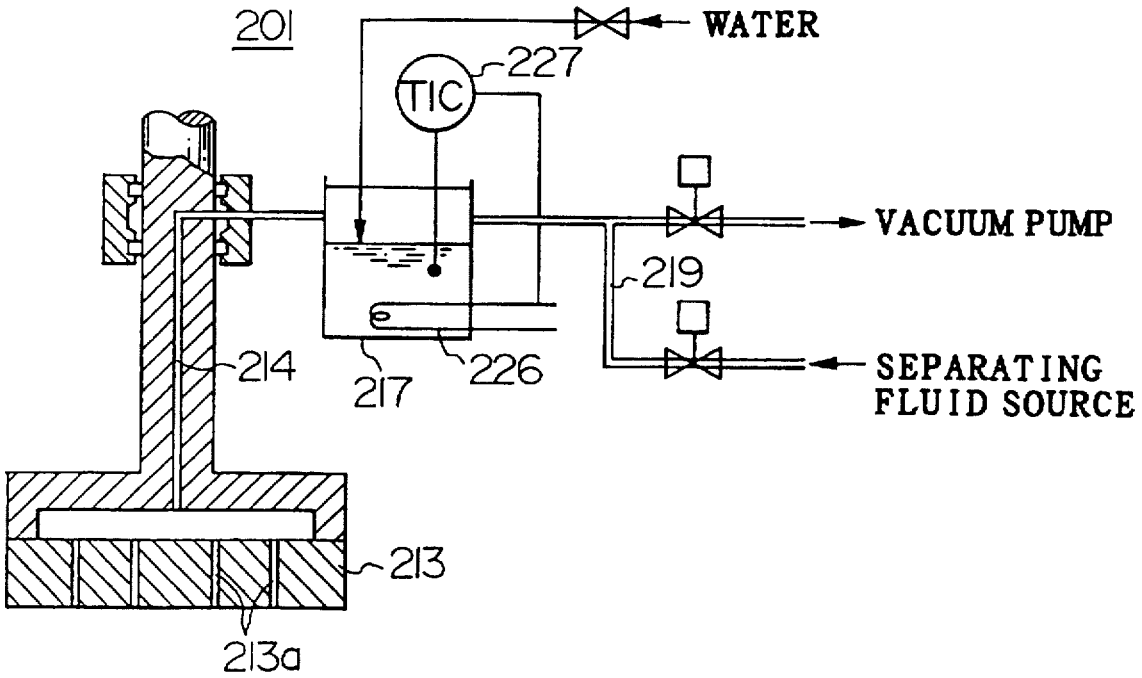
FIG. 2 is a partial sectional view showing a polishing system according to a second embodiment of the invention.

A polishing system 201 for polishing a semiconductor wafer according to a second embodiment of the invention is shown in FIG. 2. In the polishing system of this embodiment, the gelation suppression member keeps the vapor pressure of water in the vacuum passage not lower than that from the abrasive slurry. That is, in the polishing system 201 of this embodiment, a vapor supply tank 217 containing pure water therein is provided in the course of the vacuum passage. When the through holes 213*a* and the vacuum passage 214 are depressurized and the vacuum level thereof becomes higher, water in the abrasive slurry in the through holes 213*a* or the vacuum passage 214 is evaporated and the vapor of water thereof is removed from the vacuum passage 214. However, because the vapor supply tank 217 is provided in the vacuum passage 214, vapor of water is supplied to the vacuum passage 214 from the vapor supply tank 217, so that gelation of the abrasive slurry is suppressed.

It is possible to enhance such effect of gelation suppression by controlling the temperature of the water in the vapor supply tank 217 to be always approximately the same as that of the abrasive slurry. The control is performed by using a heater 226 for heating the water in the vapor supply tank 217 and a temperature control circuit 227 for detecting the temperature of the water and controlling the heater 226 on the basis of the detected temperature.

It is also preferable to supply the air for separating the wafer 112 from the polishing head 110, from a fluid passage 219 into the polishing head 110 by passing the air through the water in the vapor supply tank 217. Accordingly, it is possible to suppress evaporation of water existing in the abrasive slurry into the separating air because the air is humidified.

It is further preferable to control the vacuum level of the vacuum pump to be approximately the same as the vapor pressure of water from the abrasive slurry. Accordingly, it is possible to effectively suppress evaporation of water in the abrasive slurry because the evaporation pressure of water from the vapor supply tank 217 is reduced.

In this embodiment, since other structures are approximately the same as those of the first embodiment, a detailed explanation for such structures is omitted.

Figure 3:
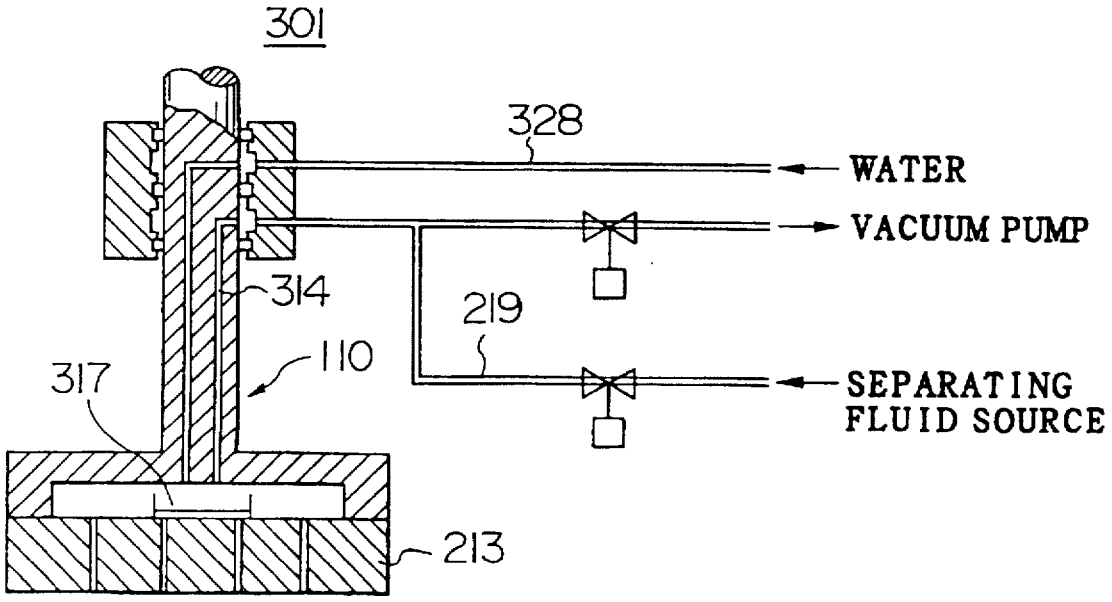
FIG. 3 is a partial sectional view showing a polishing system according to a third embodiment of the invention.

A polishing system for polishing a semiconductor wafer according to a third embodiment of the invention is shown in FIG. 3. The polishing system 301 of this embodiment is different from the second embodiment in that a vapor supply tank 317 containing pure water therein is arranged inside the polishing head 110, that is, on the upper surface of the holding member 213. According to such a structure, it is possible to very effectively suppress evaporation of water existing in the abrasive slurry because the inside of the polishing head 110 is near the positions at which the abrasive slurry is liable to exist.

In the invention, the vacuum pump is preferably one of seal water type, and the gelation suppression member is preferable to keep the temperature of sealing water of the vacuum pump not lower than that of the abrasive slurry.

According to the polishing system having such a construction, because water evaporates from the sealing water to increase the vapor pressure in the vacuum passage, evaporation of water in the abrasive slurry is suppressed and thereby gelation of the abrasive slurry can be further suppressed.

The polishing system may have a construction in which water is poured into the through holes 113*a* or 213*a* and the vacuum passage 114, 214 or 314 from the gelation suppression member to lower the concentration of the abrasive slurry sucked into the through holes or the vacuum passage. According to the polishing system having such a construction, the abrasive slurry in the through holes 113*a* or 213*a* and the vacuum passage 114, 214 or 314 is diluted by the poured water. The water may be poured prior to holding the wafer 112 on the holding member 113 or 213 by vacuum suction and may be also poured through another passage 328 other than the vacuum passage 314, as shown in FIG. 3, after holding the thin plate on the holding member by vacuum suction.

Figure 4:
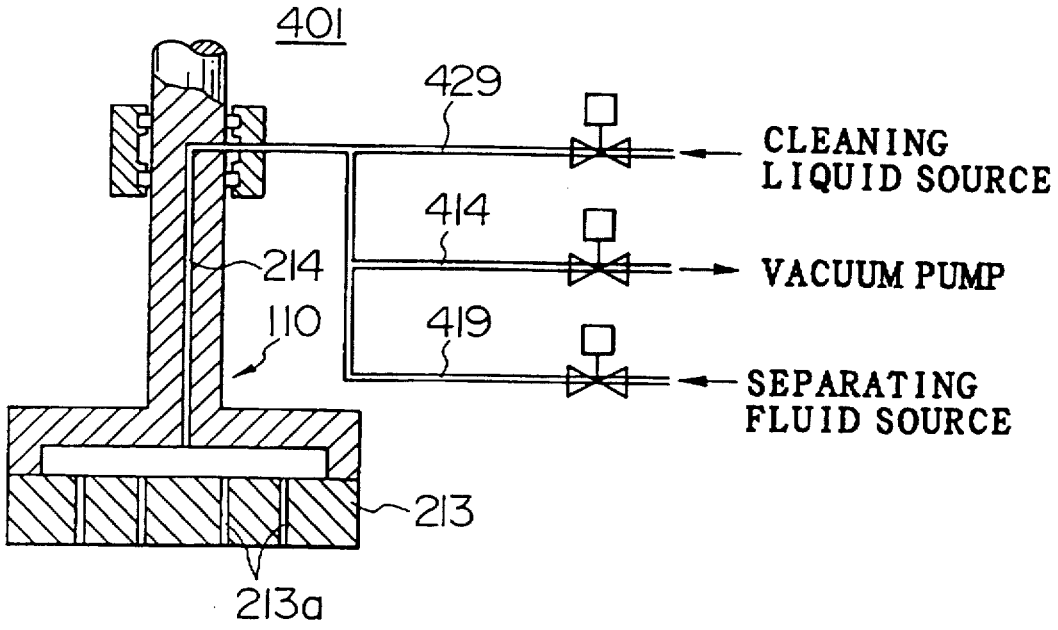
FIG. 4 is a partial sectional view showing a polishing system according to a fourth embodiment of the invention.

A polishing system according to a fourth embodiment of the invention is shown in FIG. 4. In this embodiment, the gelation suppression member has a construction which can clean the through holes 213*a* and the inner passage 214. The best time for such a cleaning is after polishing of a wafer and before polishing of the next wafer. It is preferable to carry out such cleaning at high frequencies, that is, to carry out for every piece rather than every several pieces.

In the embodiment shown in FIG. 4, after separation of the wafer 112 from the polishing head 110 by supplying the separating air into the passage 214 through a fluid passage 419, water is supplied into the passage 214 from a cleaning liquid source through a cleaning passage 429 to clean the passage 214 and the through holes 213*a*. Thereafter, water in the passage 214 and the through holes 213*a* are discharged by supplying the air into the passage 214 through the fluid passage 419, and then the polishing head 110 is moved to hold next wafer. In this case, the polishing head 110 may be operated to hold the next wafer by vacuum suction without discharging water from the passage 214 and the through holes 213*a*. According to such a cleaning of the through hole 213*a* or the passage 214, the above-described problems caused by solidification of the abrasive slurry can be eliminated.

Figure 5:
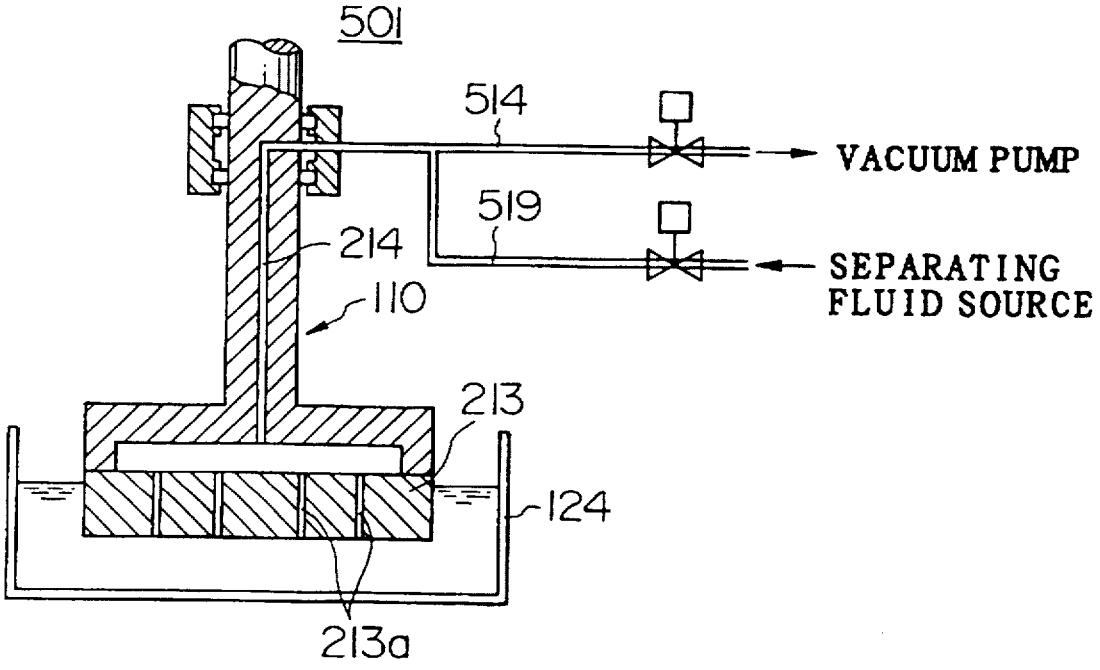
FIG. 5 is a partial sectional view showing a polishing system according to a fifth embodiment of the invention.

A polishing system according to a fifth embodiment of the invention is shown in FIG. 5. In this embodiment, the gelation suppression member has another construction which can clean the through holes 213*a* and the inner passage 214. In the embodiment shown in FIG. 5, after separation of the wafer 112, the polishing head 110 is lowered to dip the lower portion of the holding member 213 into the pure water in the cleaning tank 124. In this position, suction and discharge of pure water into and out of the through holes 213*a* and the passage 214, are alternately performed through a vacuum passage 514 and a fluid passage 519 at a suitable timing, and are repeated several times, so that the through holes 213*a* and the vacuum passage 214 are cleaned. Accordingly, the above-described problems caused by solidification of the abrasive slurry can be eliminated.

Figure 6A:
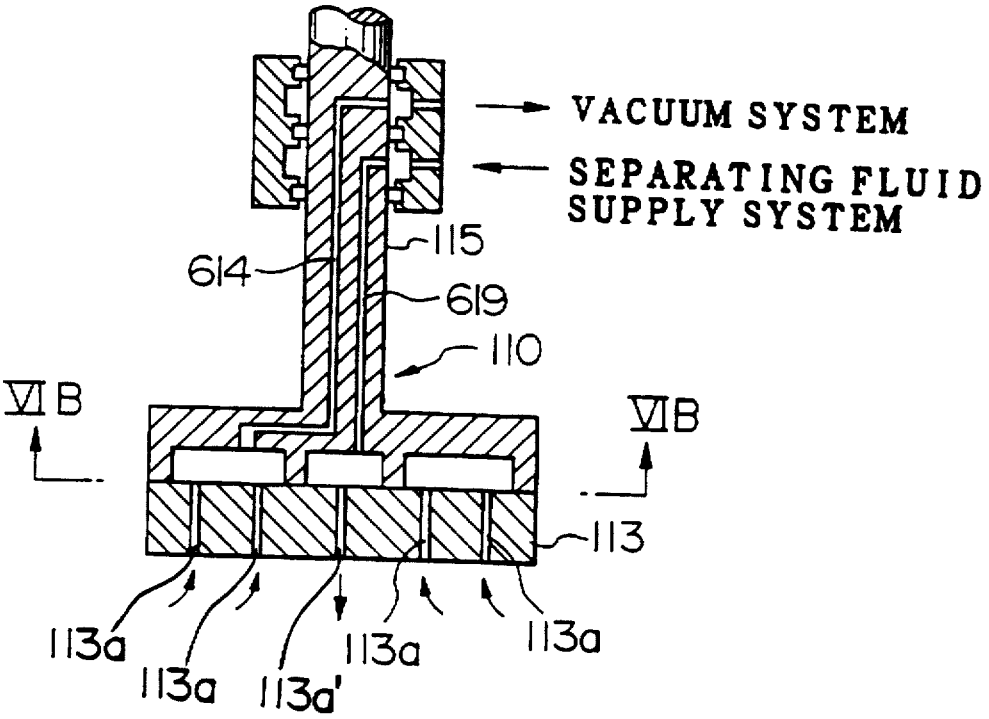
FIG. 6A is a partial sectional view showing a polishing system according to a sixth embodiment of the invention.
Figure 6B:
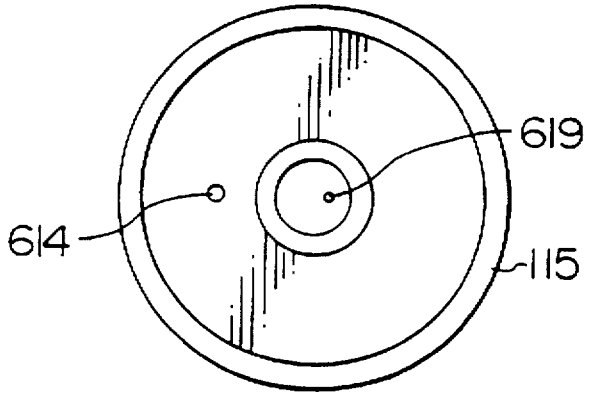
FIG. 6B is a sectional view taken on line VIB—VIB in FIG. 6A.
Figure 7:
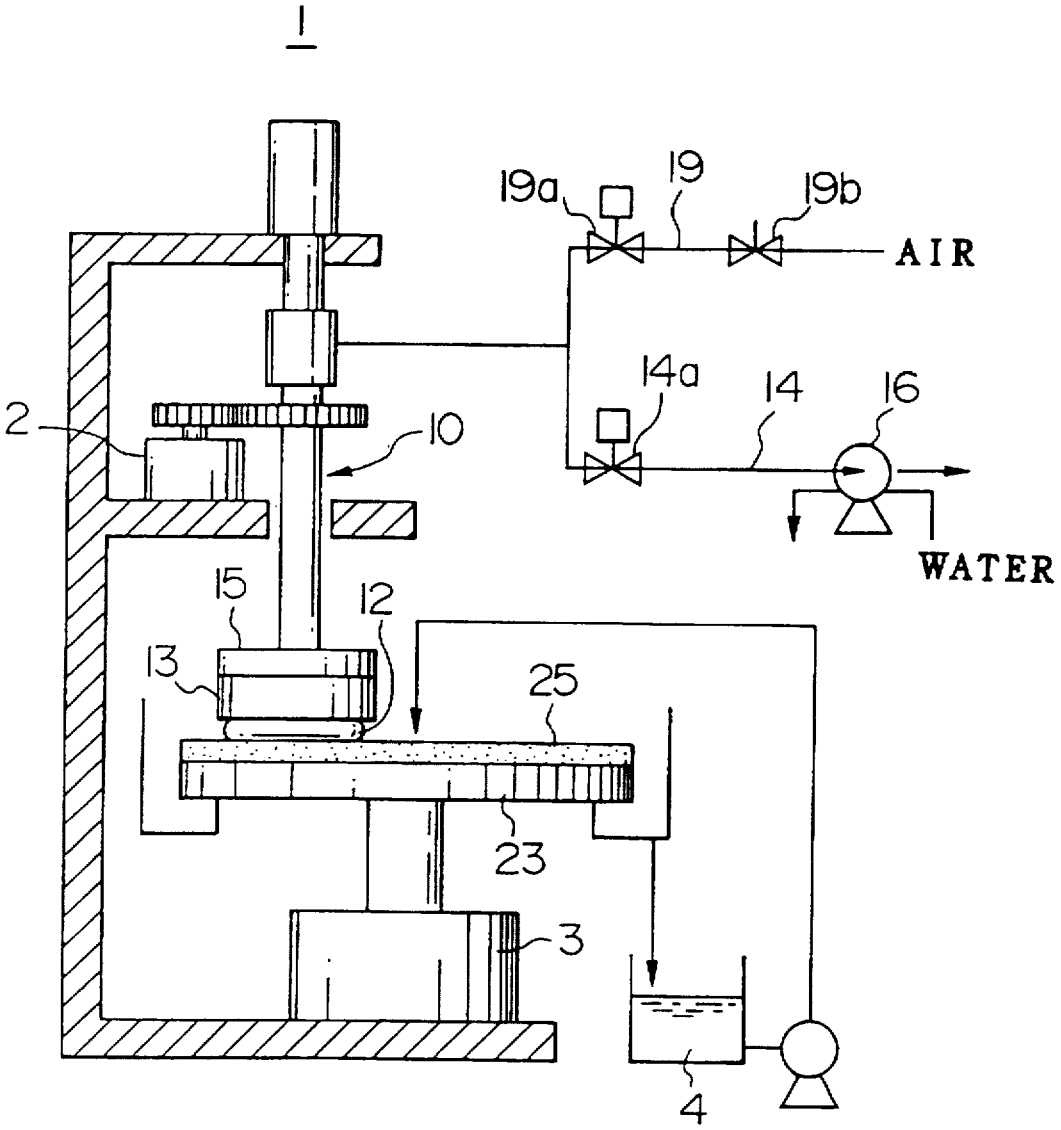
FIG.7 PRIOR ART
FIG. 7 is a schematic side view showing a conventional polishing system.
Figure 8:
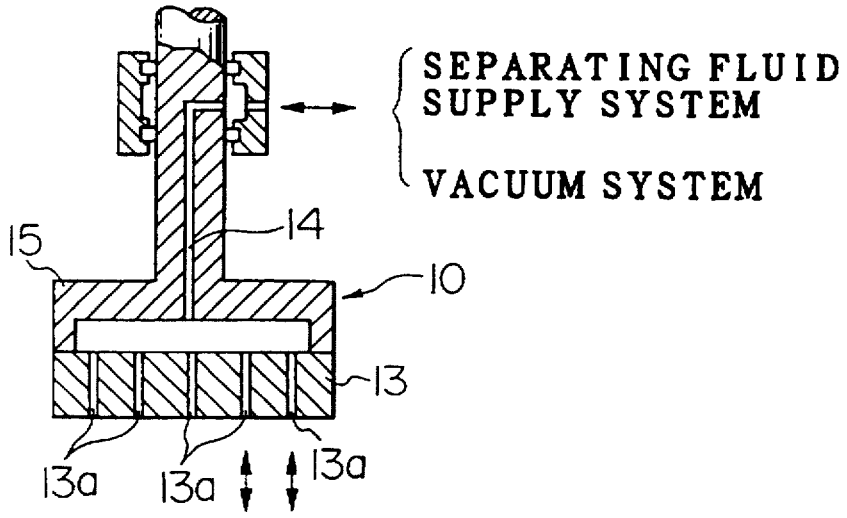
FIG.8 PRIOR ART
FIG. 8 is a sectional view of a wafer carrier in a conventional polishing system.
Figure 9A:
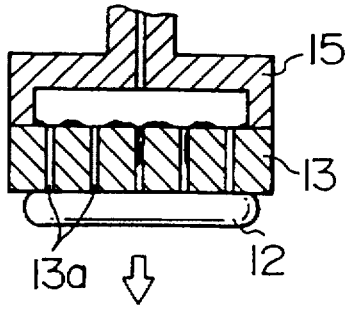
FIG.9A PRIOR ART
FIGS. 9A–9E are views for explaining problems of a conventional polishing system.
Figure 9B:
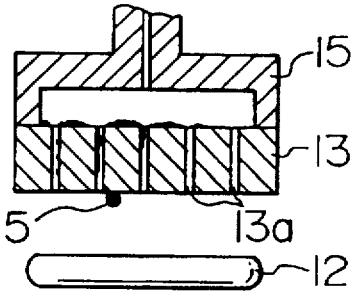
FIG.9B PRIOR ART
Figure 9C:
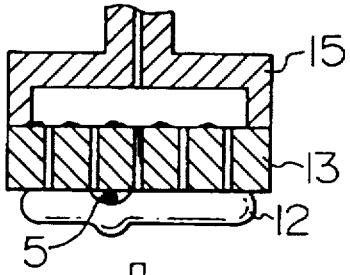
FIG.9C PRIOR ART
Figure 9D:
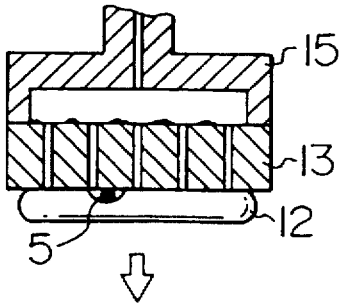
FIG.9D PRIOR ART
Figure 9E:
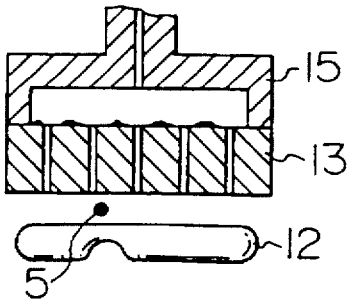
FIG.9E PRIOR ART

A polishing system according to a sixth embodiment of the invention is shown in FIGS. 6A and 6B. The polishing system of this embodiment is different from that of the first embodiment in that the vacuum passage 614 and the fluid passage 619 are provided independently. That is, in the polishing system, the vacuum passage 614 and the through holes 113*a* near the periphery of the holding member 113 are used only for vacuum suction by the vacuum pump 116; and the fluid passage 619 and the through hole 113*a*' near the center are used only for supplying the separating air onto the upper surface of the wafer 112. Therefore, during a vacuum suction through the vacuum passage 614 for holding the wafer 112 on the lower surface of the holding member 113, the abrasive slurry may be sucked into the vacuum passage 614 but is not sucked into the fluid passage 619. Then, because the air is supplied only through the fluid passage 619 when the wafer 112 is separated from the holding member 113, the abrasive slurry existing in the vacuum passage 614 is not flown to the outside thereof by the air. Therefore, it is possible to reduce the possibility of scattering of the particles caused by the abrasive slurry existing in the vacuum passage 614. The polishing head 110 may be disassembled at times to remove the gelled abrasive deposited in the through holes 113*a* and the vacuum passage 614.

Although the present invention has been explained according to the embodiments, it should also be understood that the present invention is not limited to the embodiments and that various changes and modifications may be made to the invention without departing from the gist thereof.

For example, the polishing system according to the invention is applied only for polishing a semiconductor wafer, in the above-described embodiments. However, the present invention which gives advantageous effects of improvement in flatness of an object and suppression of contamination during polishing, can be applied for polishing any objects having a flat surface, e.g., various types of thin plates, substrates, rectangular parallelepiped products or the like.

What is claimed is:

1. A polishing system for polishing an object having a flat surface, comprising:

a vacuum system comprising a vacuum pump and a vacuum passage connected to the vacuum pump;

a fluid supply system comprising a fluid source and a fluid passage connected to the fluid source;

a polishing head comprising a holding member that holds the object on a lower surface thereof, the holding member having at least one through hole in communication with the vacuum passage and the fluid passage;

a polishing member;

the object being polished by pressing the object held on the lower surface of the holding member against the polishing member while moving the holding member relative to the polishing member and supplying an abrasive slurry to the polishing member; and the object being separated from the polishing head by injecting a fluid from the fluid supply system to the object through the through hole of the holding member; and a gelation suppression member disposed in the course of the vacuum passage that suppresses gelation of the abrasive slurry sucked into the through hole or the vacuum passage.

2. A polishing system as claimed in claim 1, wherein the object is a semiconductor wafer.

3. A polishing system as claimed in claim 1, wherein the gelation suppression member comprises a vapor supply tank containing pure water therein.

4. A polishing system as claimed in claim 1, wherein the holding member has a groove for storing pure water which is formed in an inner surface thereof and is communication with the vacuum passage.

5. A polishing system as claimed in claim 1, further comprising tank containing pure water, for humidifying the fluid in the fluid passage disposed in the course of the fluid passage.

6. A polishing system as claimed in claim 1, wherein the fluid passage communicates with the vacuum passage to supply the fluid into the through hole of the holding member through a portion of the vacuum passage.

7. A polishing system as claimed in claim 1, wherein the polishing head further comprises a rotatable polishing head main body having an inner passage therein which forms a part of the vacuum passage or the fluid passage, the holding member being attached to a lower surface of the polishing head main body; and an inner space formed between the polishing head main body and the holding member in communication with the inner passage and with the through hole of the holding member.

8. A polishing system as claimed in claim 7, further comprising a vapor supply tank containing pure water disposed in the inner space between the polishing head main body and the holding member, the vapor supply tank supplying vapor to the sucked abrasive slurry in the through hole or the vacuum passage during polishing of the object.

9. A polishing system as claimed in claim 7, wherein the holding member comprises a first through hole at approximately a central position thereof and a plurality of second through holes around the first through hole; and the inner passage of the polishing head main body comprises a first inner passage which forms a part of the fluid passage and is in communication with the first through hole, and a second inner passage which forms a part of the vacuum passage and is in communication with the second through holes.

10. A polishing system as claimed in claim 1, wherein the gelation suppression member maintains the vapor pressure of water in the vacuum passage at a value not lower than the vapor pressure of water from the abrasive slurry.

11. A polishing system as claimed in claim 1, wherein the vacuum pump is a water ring type vacuum pump, and the gelation suppression member maintains sealing water of the water ring type vacuum pump at a temperature higher than the temperature of the abrasive slurry.

12. A polishing system as claimed in claim 1, wherein the gelation suppression member introduces water into the through hole and the vacuum passage to lower the concentration of the abrasive slurry sucked into the through hole or the vacuum passage.

13. A polishing system as claimed in claim 1, wherein the gelation suppression member cleans the through hole or the vacuum passage.

14. A polishing system as claimed in claim 1, wherein the gelation suppression member comprises a vapor supply tank containing pure water, a heater for heating the pure water in the vapor supply tank, and a temperature control device for detecting the temperature of the pure water and controlling the heater on the basis of the detected temperature.

15. A polishing system for polishing an object, comprising: a polishing head including a holding member for holding an object on a lower surface thereof, the holding member having at least one through hole in communication with a vacuum pump through a vacuum passage and with a fluid supply system through a fluid passage, the vacuum passage and the fluid passage being independent from each other; and a polishing member; the object being polished by pressing the object held on the lower surface of the holding member against the polishing member while moving the holding member relative to the polishing member and supplying an abrasive slurry to the polishing member; and the object being separated from the polishing head by injecting a fluid from the fluid supply system to the object through the through hole of the holding member.

16. A polishing system as claimed in claim 15, wherein the object is a semiconductor wafer.

17. A polishing system as claimed in claim 15, wherein the polishing head comprises: a rotatable polishing head main body comprising a first inner passage which forms a part of the fluid passage, a second inner passage which forms a part of the vacuum passage and a lower surface attached to the holding member, the holding member having a first through hole at approximately a central position thereof and a plurality of second through holes around the first through hole; first and second inner spaces between the polishing head main body and the holding member; and the first inner passage, the first inner space and the first through hole being in communication with one another, and the second inner passage, the second inner space and the second through holes being in communication with one another.

18. A polishing system for polishing an object having a flat surface, comprising:

a vacuum system comprising a vacuum pump and a vacuum passage connected to the vacuum pump;

a fluid supply system comprising a fluid source and a fluid passage connected to the fluid source;

a polishing head comprising a holding member that holds the object on a lower surface thereof, the holding member having at least one through hole in communication with the vacuum passage and the fluid passage;

a polishing member;

the object being polished by pressing the object held on the lower surface of the holding member, by vacuum suction through the through hole, against the polishing member while moving the holding member relative to the polishing member and supplying an abrasive slurry to the polishing member; and the object being separated from the polishing head by injecting a fluid from the fluid supply system to the object through the through hole of the holding member; and a gelation suppression member disposed in the course of the vacuum passage that suppresses gelation of the abrasive slurry sucked into the through hole or the vacuum passage by introducing vapor into the vacuum passage during polishing of the object.

* * * * *